US010053270B2

(12) United States Patent
Eckermann

(10) Patent No.: US 10,053,270 B2
(45) Date of Patent: Aug. 21, 2018

(54) BOTTLE CARRIER MADE OF FOLDABLE FLAT MATERIAL

(71) Applicant: Jens Eckermann, Bremen (DE)

(72) Inventor: Jens Eckermann, Bremen (DE)

( * ) Notice: Subject to any disclaimer, the term of this patent is extended or adjusted under 35 U.S.C. 154(b) by 19 days.

(21) Appl. No.: 15/198,518

(22) Filed: Jun. 30, 2016

(65) Prior Publication Data

US 2016/0311593 A1 Oct. 27, 2016

Related U.S. Application Data

(62) Division of application No. 14/011,026, filed on Aug. 27, 2013, now abandoned.

(60) Provisional application No. 61/696,454, filed on Sep. 4, 2012.

(51) Int. Cl.
*B65D 71/68* (2006.01)
*B65D 71/58* (2006.01)

(52) U.S. Cl.
CPC ..... *B65D 71/0081* (2013.01); *B65D 71/0025* (2013.01); *B65D 71/0077* (2013.01); *B65D 2571/0066* (2013.01); *B65D 2571/00141* (2013.01); *B65D 2571/00265* (2013.01); *B65D 2571/00388* (2013.01); *B65D 2571/00419* (2013.01); *B65D 2571/00487* (2013.01); *B65D 2571/00506* (2013.01); *B65D 2571/00858* (2013.01)

(58) Field of Classification Search
CPC ..... B65D 71/0081; B65D 71/0025; B65D 71/0077; B65D 2571/00141; B65D 2571/00388; B65D 2571/00419; B65D 2571/00487; B65D 2571/00506; B65D 2571/0066; B65D 2571/00858
USPC ..... 206/198, 187, 170, 174, 197, 173, 191
See application file for complete search history.

(56) References Cited

U.S. PATENT DOCUMENTS 3,198,380 A 8/1965 Gish et al.
3,202,313 A 8/1965 Wainberg
3,266,663 A * 8/1966 Ringler ..... B65D 71/0077 206/178
3,572,544 A * 3/1971 Forrer ..... B65D 71/0022 206/187
3,712,505 A * 1/1973 Slevin ..... B65D 71/0022 206/187
3,814,238 A 6/1974 Wood
(Continued)

FOREIGN PATENT DOCUMENTS

BE 554676 2/1957

*Primary Examiner* — Chun Cheung
(74) *Attorney, Agent, or Firm* — Vidas Arrett & Steinkraus

(57) ABSTRACT

A bottle carrier made of foldable flat material having a handle comprising two overlapping outer handle walls and two inner handle walls between the outer handle walls, front walls, perpendicular to the handle and two front wall sections on different sides of the handle, connecting straps, connected with an inner edge of a front wall section via a front folding line, folded around front folding lines and connected with the handle, longitudinal walls, parallel to the handle and connected with the outer edges of two front wall sections via side folding lines, a bottom wall, connected with lower edges of longitudinal walls via bottom folding lines, separating webs, connected with lower edge areas of the outer handle walls via inner web folding lines, folded around the inner web folding lines out of the lower edge areas, an insert is arranged between the two outer handle walls.

16 Claims, 8 Drawing Sheets

(56) References Cited

U.S. PATENT DOCUMENTS

| | | | | | |
|---|---|---|---|---|---|
| 3,917,060 | A * | 11/1975 | Wood | B65D 71/0022 | 206/187 |
| 3,938,756 | A * | 2/1976 | Katoh | G11B 15/08 | 242/333.2 |
| 4,205,748 | A * | 6/1980 | Wilson | B65D 71/0022 | 206/174 |
| 4,722,437 | A | 2/1988 | Walsh | | |
| 4,986,416 | A | 1/1991 | Arthurs | | |
| 6,131,729 | A * | 10/2000 | Eckermann | B65D 71/0077 | 206/173 |
| 7,779,997 | B2 * | 8/2010 | Cuomo | B65D 71/0022 | 206/162 |
| 2005/0211577 | A1 | 9/2005 | Bakx | | |
| 2006/0148629 | A1 | 7/2006 | Cuomo | | |

* cited by examiner

BOTTLE CARRIER MADE OF FOLDABLE FLAT MATERIAL

CROSS-REFERENCE TO RELATED APPLICATIONS

This Divisional utility application claims priority to U.S. application Ser. No. 14/011,026 filed on Aug. 27, 2013 which claimed priority to provisional application 61/696,454, filed on Sep. 4, 2012, the disclosures of which are incorporated herein by reference.

STATEMENT REGARDING FEDERALLY SPONSORED RESEARCH

Not applicable.

BACKGROUND OF THE INVENTION

The invention relates to a bottle carrier made of foldable flat material.

Bottle carriers of the type according to the invention have on both sides of the handle dividers defined by the front walls, longitudinal walls and separating webs, into which bottles are insertable. They are also called "open basket" bottle carriers or "basket-like" bottle carriers. The bottles are held in the dividers separated from each other so that glass contact with the bottles is reduced. Such bottle carriers with separating webs, which are folded out of the lower edge areas of the outer handle walls and the upper edge areas of the longitudinal walls, are called "strap-style" bottle carriers due to the strap shape of the separating webs. The separating webs are connected with the upper edge areas of the longitudinal walls via vertical, external web folding lines. The handle and the longitudinal walls have recesses in the areas from which the separating webs are folded, which disturb the outward appearance. The separating webs only have a limited height so that glass contact between neighboring bottles on the same side of the handle is only slightly restricted. A large opening is present below the handle, through which the neighboring bottles can easily come in contact on different sides of the handle.

U.S. Pat. No. 3,814,238, the entire contents of which is incorporated herein by reference, describes an "open basket" bottle carrier of "strap-style" type. The inner handle walls are connected with the front-side edges of the outer handle walls via front-side handle folding lines and folded against their insides. The outer handle walls are interconnected by outer handle folding lines and the inner handle walls by inner handle folding lines. When folded over each other, the outer handle walls and the inner handle walls are folded together around the outer and inner handle folding lines. Neighboring connecting straps are folded together, glued together and arranged between front-side edge areas of the outer handle walls and glued with them. The connecting straps protrude downwards from the lower edge of the handle and extend up to shortly before the bottom wall.

Such bottle carriers are cost-effective since they can be produced from a one-piece blank with relatively low material use. The assembly and folding of these bottle carriers are also relatively easy. However, it has been shown that such bottle carriers can fail under high loads. This can be compensated for through use of cardboard with a high rigidity. The material costs are hereby increased.

Against this background, an object of the invention is to create a bottle carrier of the initially described type, which withstands loads better.

The bottle carrier according to the invention made of foldable flat material has:

- a handle comprising two overlapping outer handle walls and two inner handle walls arranged between the outer handle walls,
- front walls, which are aligned perpendicular to the handle and have respectively two front wall sections on different sides of the handle,
- connecting straps, which are connected with an inner edge of a front wall section via a front folding line, folded around the front folding lines between front-side edge areas of the outer handle walls and connected with the handle,
- longitudinal walls, which extend parallel to the handle and each of which are connected with the outer edges of two front wall sections of different front walls via side folding lines,
- a bottom wall, which is connected with the lower edges of the longitudinal walls via bottom folding lines,
- separating webs, which are connected with lower edge areas of the outer handle walls via inner web folding lines, folded around the inner web folding lines out of the lower edge areas of the outer handle walls and aligned parallel to the front walls, characterized in that
- an insert is arranged between the two outer handle walls, which has inner front-side edge areas on both front sides, which overlap with the connecting straps and are connected with them.

BRIEF SUMMARY OF THE INVENTION

The invention is based on the conclusion that, in conventional bottle carriers, the connection of the connecting straps by the handle is insufficient. In conventional bottle carriers, this connection is only established by the outer handle walls, between the outer edge areas of which the connecting straps are folded and with which the connecting straps are glued. However, the inner handle walls do not contribute to the interconnection of the two connecting straps, because they end on one or on both sides before the neighboring connecting straps. The limited expansion of the inner handle walls of conventional bottle carriers is based on the fact that the surface of the one-piece blank for the production of the bottle carrier is taken in mainly by the outer handle walls in the area limited by the longitudinal walls, front-wall halves and connecting straps. As a result, the front walls can give way outwardly in the lower area when loaded with inserted bottles, whereby the connections of the connecting straps with the handle and the connections of the front walls with the longitudinal walls can be loaded such that the bottle carrier fails. According to the invention, this defect can be corrected in that the handle is additionally equipped with an insert, which is arranged between the two outer handle walls. The insert has inner front-side edge areas on its two front sides, which overlap with the connecting straps and are connected with them. Through the insert, the gap between the connecting straps is additionally bridged and thereby reinforced. As a result, greater forces can be transferred between the connecting straps. The giving way of the front walls towards the outside is hereby prevented or respectively greatly reduced and the bottle carrier is protected from failure. As a result, flat materials with a low rigidity can be used for the bottle carrier. This enables the use of cardboard with a lower grammage than conventional bottle carriers. Primary fibre cardboard is preferably used. But the invention also promotes the use of secondary fibre cardboard or respectively recycled cardboard. The insert and the other parts of the bottle carrier can be made of the same type of flat material or different types of flat material.

According to one embodiment, the outer handle walls are interconnected on the top by an outer handle folding line and are folded together around the outer handle folding line and the inner handle walls are connected with the front-side edges of the outer handle walls via front-side handle folding lines and are folded against the outer handle walls around the front-side handle folding lines.

According to a further embodiment, the connecting straps are connected with the front-side edges of the outer handle walls on one of the two front walls on the top via continuations of the front folding lines.

According to a further embodiment, the inner handle walls are interconnected on the top via an inner handle folding line and folded together around the inner handle folding line.

These embodiments are material-saving and advantageous for the folding process.

According to one embodiment of the invention, the insert has two overlapping insert walls. In this manner, a six-layered handle is created, which is particularly stable. The insert can also have more than two stacked insert walls or also only a single insert wall. According to a further embodiment, the insert walls are interconnected on the top by an insert folding line, which is arranged below the outer handle folding line. This facilitates the assembly of the blanks and the folding process.

According to a further embodiment, the insert does not protrude beyond the lowest points of the outer handle walls and the inner handle walls. As a result, the insert is covered fully or to a great extent by the outer handle walls and thus inconspicuously housed. This favours the use of materials for the insert, which would impair its outward appearance on an outside of the bottle carrier that is easily visible from outside. The bottle carrier is thus suitable in particular for the use of wastepaper sheets and recycled material for the insert.

According to a further embodiment, the insert has a straight bottom edge, which is arranged at the height of the bottom ends of the inner web folding lines. Through this insert, the recesses formed during the folding of the separating webs out of the outer handle walls are covered. The weakness of the handle in the area of the folded out separating webs is hereby compensated for. Moreover, this embodiment prevents more effectively bottle contact between neighboring bottles on different sides of the handle and the outward appearance of the bottle carrier is improved. The insert is also housed inconspicuously in the handle in this embodiment.

According to one embodiment, the height of the front wall sections increases towards the handle. As a result, the vertical expansion of the outer and inner handle walls decreases towards a front wall as the outer and inner handle walls are made up of the areas of the blank remaining between the longitudinal walls, front wall sections and connecting straps. In the case of this embodiment, the insert with the straight bottom edge can advantageously replace the cardboard lacking next to the front wall on the bottom made up of the outer and inner handle walls. As a result, the stability of the bottle carrier is further improved. The higher front walls improve the power flow from the handle into the front walls, hold the bottles on the front sides more securely and enable a larger imprint.

According to a further embodiment, the separating webs are connected with the upper edge areas of the longitudinal wall on the same side of the handle on the outside via outer web folding lines. This is known from conventional bottle carriers, increases the stability of the bottle carrier and contributes to the avoidance of glass contact. However, this embodiment determines that recesses are visible next to the outer web folding lines on the upper edge area of the longitudinal wall, out of which the separating webs are folded in the area of the longitudinal walls.

According to another embodiment, the separating webs end before the respectively neighboring longitudinal walls and the insert has additional separating webs linked to the lower edge areas of the two insert walls via additional inner web folding lines, which are folded out of the insert walls, connected with the separating webs in an inner section overlapping the separating webs and connected with the insides of the neighboring longitudinal walls on the outer ends via web connecting straps. This embodiment has separating webs, which increase the stability of the bottle carrier by bridging the gap between the handle and the two longitudinal walls and prevent glass contact. However, this embodiment avoids the recesses on the upper edge of the longitudinal wall, which are caused by the folding of the outer ends of the separating webs out of the longitudinal walls in the case of conventional bottle carriers. In the case of the bottle carrier according to the invention, the outward separating webs are namely connected with the insides of the neighboring longitudinal walls via the web connecting straps. An "open basket" bottle carrier of the "strap-style" type is hereby first enabled, in that the longitudinal walls have an upper edge free of recesses. This is particularly advantageous for the rigidity and the outward appearance of the bottle carrier and a large imprint on the bottle carrier.

According to a further embodiment, the separating webs end at a distance from the respectively neighboring longitudinal wall and the further separating webs are connected with the insides of the neighboring longitudinal walls on the outer ends of an outer section protruding over the separating webs via web connecting straps.

According to a further embodiment, the insert has on the bottom at least one middle wall section protruding over the inner web folding lines. Through the middle wall section, the opening is closed partially or completely below the handle. Glass contact among bottles arranged next to each other on different sides of the handle can hereby be completely prevented.

According to a further embodiment, both insert walls of the insert have a middle wall section on the bottom.

According to a further embodiment, the middle wall sections have separating flaps linked via vertical separating wall folding lines adjacent to neighboring separating webs, which are connected with them in an overlapping area with the neighboring separating webs. The separating flaps can securely prevent glass contact between neighboring bottles on the same side of the handle.

According to a further embodiment, the separating webs end before the respectively neighboring longitudinal walls and the separating flaps are connected with the insides of the neighboring longitudinal walls on the outer ends via separating flap connecting straps. This embodiment also avoids the recesses on the upper edge of the longitudinal wall, which are caused by the folding of the outer ends of the separating webs out of the longitudinal walls in the case of conventional bottle carriers. In the case of the bottle carrier according to the invention, the separating flaps are namely connected with the insides of the neighboring longitudinal walls via the separating flap connecting straps. Hereby, too, an "open basket" bottle carrier of the "strap-style" type is first enabled, in that the longitudinal walls have a straight upper edge free of recesses. This bottle carrier also has an improved rigidity and an improved outward appearance and side walls, which can be provided with an imprint over a larger area. A further advantage is that the separating flaps avoid in a particularly effective manner glass contact between neighboring bottles.

According to a further embodiment, the separating webs end at a distance from the respectively neighboring longitudinal wall and the separating flaps are connected with the insides of the neighboring longitudinal side on the outer ends of an outer section protruding over the separating webs via web connecting straps.

According to a further embodiment, at least one middle wall section is arranged between a front wall and an inner web folding line and/or between two inner web folding lines. Next to one or both front walls, a sufficient separation of the two dividers can be given on different sides of the handle by the connecting flaps.

According to a further embodiment, the outer handle walls, the inner handle walls and the insert have overlapping handle openings. The handle openings facilitate the carrying of the bottle carrier.

According to embodiments, the outer and inner handle walls, the front walls, the connecting straps, the longitudinal walls, the bottom wall and the separating webs are made of a first one-piece blank of foldable flat material and the insert is made of a second one-piece blank of foldable flat material.

According to a further embodiment, the bottle carrier has at least one imprint on the outsides of the outer handle walls and/or the front walls and/or the longitudinal walls and/or the bottom and/or the insert.

According to a further embodiment, the insert is a wastepaper sheet.

According to a further embodiment, the wastepaper sheet is provided with a further imprint on the original imprint. Wastepaper sheets have an imprint. They can advantageously and subsequently be provided with an additional imprint on the original imprint, which is adjusted to the imprint of the other parts of the bottle carrier. Thus, wastepaper sheets can then also be used without impairing the outward appearance of the bottle carrier for the insert when it protrudes from the lower edge of the handle.

Bottle carriers according to the invention can be designed in particular for six bottles with 0.33 liters and 0.5 liters of filling volume. But, bottle carriers according to the invention can also be designed for a smaller or larger number of bottles, for example for four, eight or ten bottles. The bottle carriers are preferably used for beer bottles.

In the present invention, the designations "top" and "bottom" and "vertical" and "horizontal" refer to an alignment of the bottle carrier with the bottom wall on a horizontal subsurface and the handle above the bottom wall.

The front folding lines, side folding lines, (additional) inner and outer web folding lines of the bottle carrier are preferably aligned vertically. The outer and inner handle folding lines, insert folding lines and bottom folding lines of the bottle carrier are preferably aligned horizontally.

The front walls, longitudinal walls, connecting straps and the handle are preferably aligned vertically and the bottom wall is preferably aligned horizontally.

The handle is preferably plate-like and the insert preferably also.

The invention will be further explained with reference to the accompanying drawings of exemplary embodiments. The drawings show in:

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

In the below explanation of different exemplary embodiments, similarly named components of different bottle carriers are provided with the same leading reference numbers, followed by a point and a subsequent, individual reference number. In summary, these components are also only labelled with the leading reference number, in particular in the list of reference numbers and in the claims.

Figure 1:
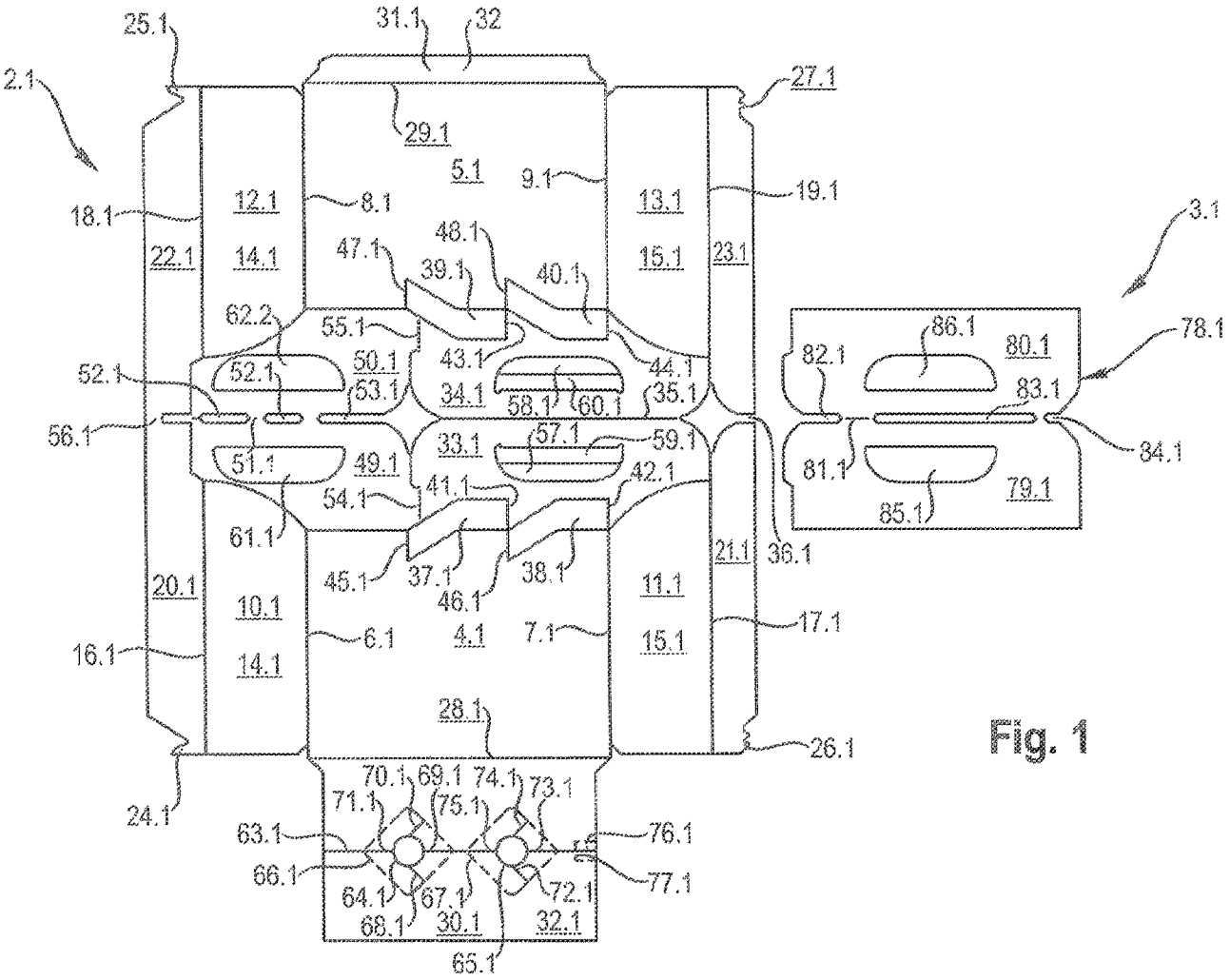
FIG. 1 blanks of a bottle carrier with an insert for stabilizing the bottle carrier in a top view.
Figure 2:
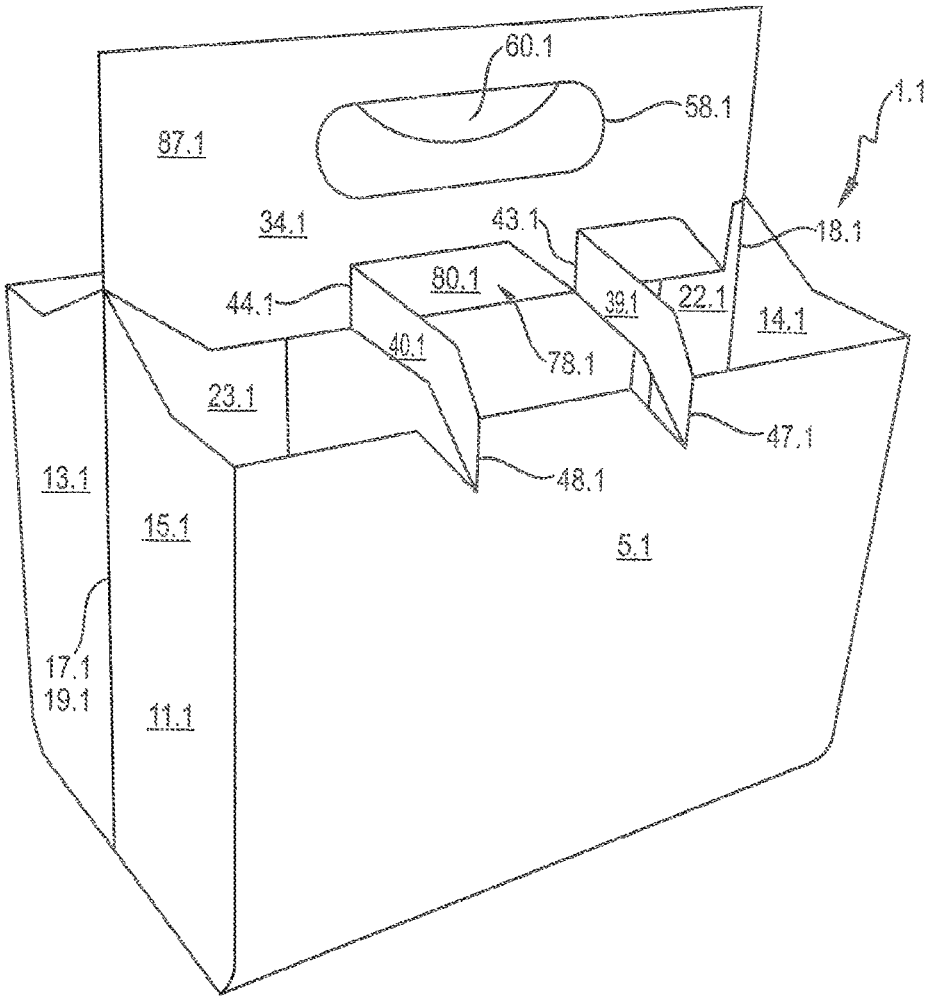
FIG. 2 a bottle carrier formed from the blanks from FIG. 1 in a perspective view diagonally from the top and from the side.

According to FIGS. 1 and 2, a bottle carrier 1.1 is formed from a blank 2.1 for the main part and a blank 3.1 for the insert.

The blank 2.1 comprises mainly rectangular longitudinal walls 4.1, 5.1, to which front wall sections 10.1 through 13.1 of two front walls 14.1, 15.1 are linked via side folding lines 6.1, 7.1, 8.1, 9.1. Connecting straps 20.1 through 23.1 are in turn linked to the front wall sections 10.1 through 13.1 via front folding lines 16.1 through 19.1. The front folding lines 16.1 through 19.1 are aligned parallel to the side folding lines 6.1 through 9.1.

The connecting straps 20.1 through 23.1 are mainly strip-like. The connecting straps 20.1, 21.1 each have a hook 24.1, 25.1 on the ends facing away from each other. The connecting straps 22.1, 23.1 each have a pair of successive, small hooks 26.1, 27.1 on the ends facing away from each other.

The front wall sections 10.1, 11.1 and 12.1, 13.1 are mainly rectangular on the bottom. On the top on the sides facing each other, they have a curved, bent edge so that the height of the front wall sections 10.1 through 13.1 increases starting from the respectively neighboring longitudinal wall 4.1, 5.1 to the respectively neighboring connecting strap 20.1 through 23.1.

Bottom wall sections 30.1, 31.1 are linked to the longitudinal walls 4.1, 5.1 respectively via a bottom folding line 28.1, 29.1. The bottom folding lines 28.1, 29.1 are aligned perpendicular to the side folding lines 6.1 through 9.1. In the example, the bottom wall section 30.1 is designed as a larger rectangular bottom wall section and the bottom wall section 30.2 is designed as a bottom strap tapering towards the outside. The bottom wall sections 30.1, 31.1 together form a bottom wall 32.1.

Outer handle walls 33.1, 34.1, which are mainly strip-like, are arranged between the longitudinal walls 4.1, 5.1 and the front wall sections 12.1, 13.1 as well as the connecting straps 20.1 through 23.1. The outer handle walls 33.1, 34.1 are interconnected by an outer handle folding line 35.1. The outer handle folding line 35.1 is aligned perpendicular to the side folding lines 6.1 through 9.1. Furthermore, the outer handle wall 33.1 is connected with the connecting strap 22.1 by a continuation of the front folding line 18.1 and the outer handle wall 34.1 is connected with the connecting strap 23.1 through a continuation of the front folding line 19.1. A strip-like cutout 36.1 is present between the connecting straps 22.1, 23.1. The neighboring edges of the outer handle wall 33.1 and the connecting strap 23.1 as well as the outer handle wall 34.1 and the connecting strap 23.1 are symmetrically rounded with respect to an imaginary connecting line through the front folding lines 18.1, 19.1.

The outer handle walls are connected with the respectively neighboring longitudinal wall 4.1, 5.1 on the edges facing away from each other via strip-like separating webs 37.1 through 40.1. The separating webs 37.1 through 40.1 are respectively connected with the neighboring outer handle wall 33.1, 34.1 via an inner web folding line 41.1 through 44.1 and with the neighboring longitudinal wall 4.1, 5.1 via an outer web folding line 45.1 through 48.1. The inner web folding lines 41.1 through 44.1 and the outer web folding lines 45.1 through 48.1 are aligned parallel to the side folding lines 6.1 through 9.1.

The separating webs 37.1 through 40.1 have a progression parallel to the outer handle folding line 35.1 in an inner section, which is adjacent to the inner web folding line 41.1 through 44.1. Furthermore, the separating webs 37.1 through 40.1 have an outer section tilted towards the inner section in an obtuse angle, said outer section being connected to an outer web folding line 45.1 through 48.1.

Furthermore, inner handle walls 49.1, 50.1 are arranged between the longitudinal walls 4.1, 5.1, the front wall sections 10.1, 11.1 and the connecting flaps 20.1, 21.1. The inner handle walls 49.1, 50.1 are interconnected via an inner handle folding line 51.1. The inner handle folding line 51.1 is interrupted by strip-like cutouts 52.1 through 53.1. The inner handle walls 49.1, 50.1 are connected with the edges of the outer handle walls 33.1, 34.1 via front-side handle folding lines 54.1, 55.1, which lie opposite the front-side edges of the outer handle walls 33.1, 34.1, which are connected with the connecting straps 22.1, 23.1.

The connecting straps 20.1, 21.1 are interconnected by a connecting folding line 56, which is aligned with the outer handle folding line 35 and the inner handle folding line 51.

The outer handle wall 33.1 and the inner handle wall 49.1 have neighboring curved, bent edges, which are arranged symmetrically with respect to a line through the front-side handle folding lines 54.1, 55.1. The outer handle wall 34.1 and the inner handle wall 50.1 are provided in the same manner with bent edges.

In the outer handle walls 33.1, 34.1, outer handle openings 57.1, 58.1 are provided with handle release straps 59.1, 60.1 on the neighboring edges parallel to the outer handle folding line 35.1. The outer handle openings 57.1, 58.1 and the handle release straps 59.1, 60.1 are arranged symmetrically with respect to the outer handle folding line 35.1.

The inner handle walls 49.1, 50.1 are provided with inner handle openings 61.1, 62.1, which are arranged symmetrically with respect to the inner handle folding line 51.1. Furthermore, the inner handle openings 61.1, 62.1 and the outer contours of the outer handle openings 57.1, 58.1 are arranged mainly symmetrically to an imaginary line through the front-side handle folding lines 54.1, 55.1.

The bottom wall section 30.1 has in the middle a central bottom folding line 63.1, which runs parallel to the bottom folding line 28.1. Two circular cutouts 64.1, 65.1 are arranged on the central bottom folding line 63.1. A quadratic folding line arrangement 66.1, 67.1 is arranged around each cutout 64.1, 65.1, the quadratic folding line arrangement 66.1, 67.1 being arranged on the central bottom folding line 63.1 with diametrically opposing corners. Starting from the circular cutouts 64.1, 65.1, four perforated lines 68.1 through 71.1 and 72.1 through 75.1 each extend towards the folding line arrangement 66.1, 67.1. Areas for the insertion of mandrels of a drink crate are formed by the circular cutouts 64.1 through 65.1, the folding line arrangements 66.1, 67.1 as well as the perforated lines 68.1 through 71.1 as well as 72.1 through 75.1.

Starting from the right edge of the bottom wall section 30.1 in FIG. 1, a short incision 78.1, which is bordered by a perpendicular, additional short incision 76.1, extends on the central bottom folding line 63.1.

The blank 3.1 of an insert 78.1 comprises two insert walls 79.1, 80.1, which are interconnected along the insert folding line 81.1. The insert folding line 81.1 is interrupted by additional strip-like cutouts 82.1 through 84.1, wherein the cutouts 82.1 through 84.1 are open towards the front sides of the blanks 3.1. The insert walls 79.1, 80.1 each have a rectangular shape. The gaps between the outer edges of the two insert walls 79.1, 80.1 and the insert folding line 81 match the gaps between the outer ends of the inner web folding lines 41.1 through 44.1 and the outer handle folding line 35.1.

The front-side contours of the insert walls 79.1, 80.1 in the areas neighboring the insert folding lines 81.1 match the front-side contours of the outer handle walls 33.1, 34.1 in the areas neighboring the outer handle folding line 35.1.

The insert walls 79.1, 80.1 each have an additional inner handle opening 85.1, 85.2, which is arranged symmetrically with respect to the insert folding line 81.1.

The bottle carrier is assembled as follows.

First, the blank 3.1 is placed on the blank 2.1 so that the insert folding line 81.1 is arranged exactly above the outer handle folding line 35.1 and the insert walls 79.1, 80.1 and the outer handle walls 33.1, 34.1 are arranged exactly on top of each other in the areas adjacent to the insert folding line 81.1 and the outer handle folding line 35.1. In this arrangement, the outer edges of the insert walls 79.1, 80.1 cover the outer handle walls 33.1, 34.1 in the areas, from which the separating webs 37.1 through 40.1 and the bent, upper areas of the front wall sections 12.1, 13.1 are cut out. The additional inner handle openings 85.1, 86.1 are arranged exactly on top of each other above the outer handle openings 57.1, 58.1. Then, the inner handle walls 49.1, 50.1 are folded around the front-side handle folding lines 54.1, 55.1 against the insert walls 79.1, 80.1 and glued with them. The insert walls 79.1, 80.1 are thereby glued with the outer handle walls 33.1, 34.1.

Then, the connecting straps 22.1, 23.1 are folded around the front folding lines 18.1, 19.1 against the neighboring front-side edge areas of the insert walls 79.1, 80.1 and glued with them. Furthermore, the front wall sections 10.1, 12.1 are folded around the side folding lines 6.1, 7.1 against the longitudinal walls 4.1, 5.1, wherein the neighboring sections of the connecting straps 20.1, 21.1 come in contact on the front-side edge areas of the inner handle walls 49.1, 50.1 next to the front-side handle folding lines 54.1, 55.1 and are glued with them.

Then, the combined blanks 2.1, 3.1 are folded together around the outer handle folding line 35.1, insert folding line 81.1, inner handle folding line 51.1 and connecting folding line 56.1, wherein the inner handle walls 49.1, 50.1 and the connecting straps 20.1, 21.1 and the connecting straps 22.1, 23.1 are glued together. Finally, the bottom wall section 30.1 is folded together around the central bottom folding line 63.1 and the longitudinal-side edge area of the bottom wall section 30.1 is hereby glued with the additional bottom wall section 31.1.

The bottle carrier 1.1 assembled in this manner is easily erectable by pressing together on the front folding lines 18.1, 19.1 and the side folding lines 6.1, 8.1. Finally, the bottom wall 32.1 is caught with the hook, which is formed from the exactly stacked hooks 24.1, 25.1 on the one front side and the exactly stacked hooks 26.1, 27.1 on the other front side. The catching of the bottom wall 32 by means of the stacked hooks 26, 27 is facilitated and secured by the incisions 72, 73.

In this erected position, the bottle carrier 1.1 can be filled with a group of six bottles. The outer handle walls 33.1, 34,1 and the inner handle walls 49.1, 50.1 together form a handle 87.1, which is reinforced by the insert 78.1. The insert 78 fills the areas opened by folding the separating webs 37.1 through 40.1 out of the outer handle walls 33.1, 34.1 and also the areas opened by folding the upper curved edge areas of the front wall sections 12.1, 13.1 out of the upper handle walls 33.1, 34.1. Moreover, the insert 78.1 bridges the gap between the stacked connecting straps 20.1, 21.1 and 22.1, 23.1 and hereby stabilizes the bottle carrier 1.1.

Figure 3:
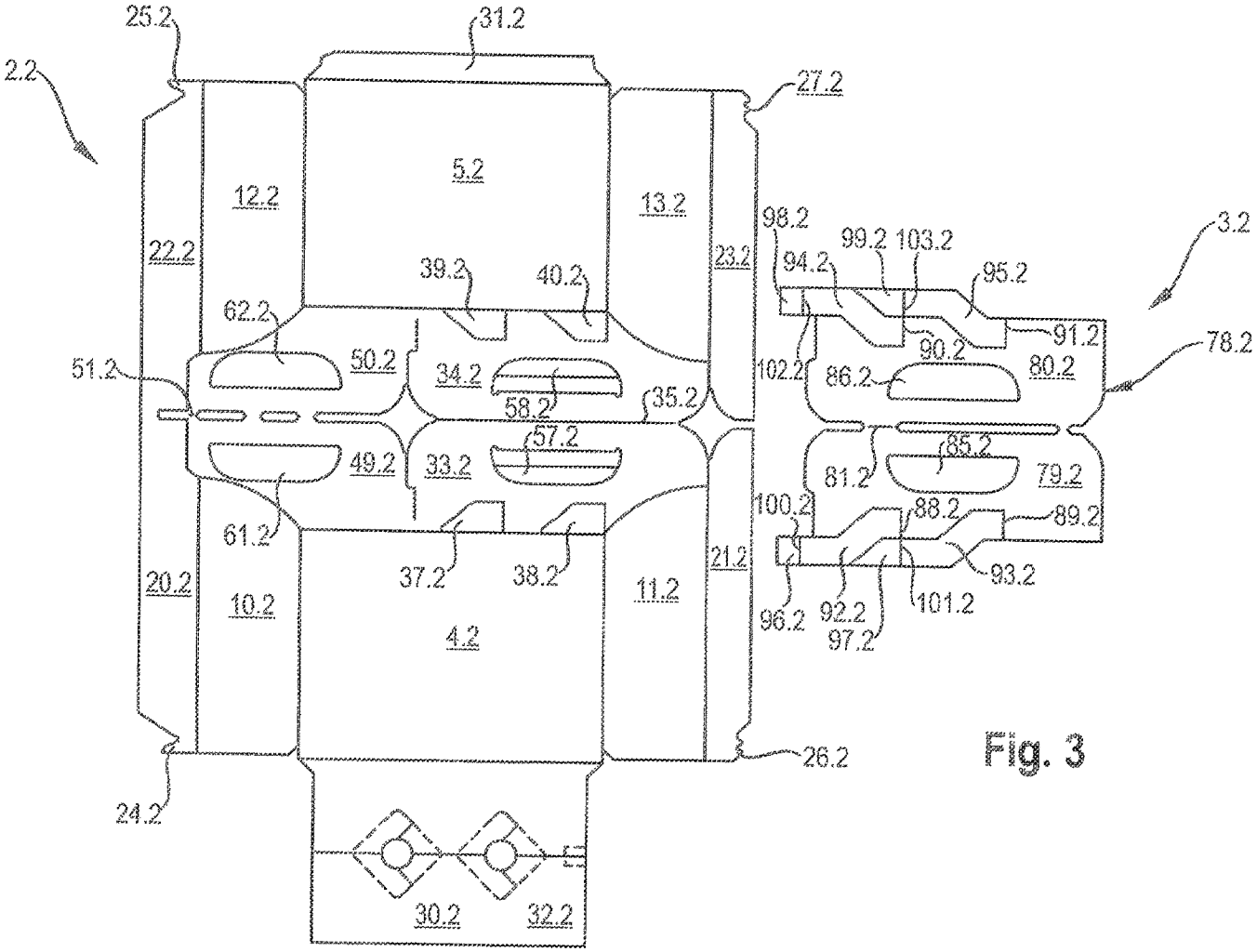
FIG. 3 blanks of a bottle carrier with an insert for stabilizing the bottle carrier and providing further separating webs in a top view.
Figure 4:
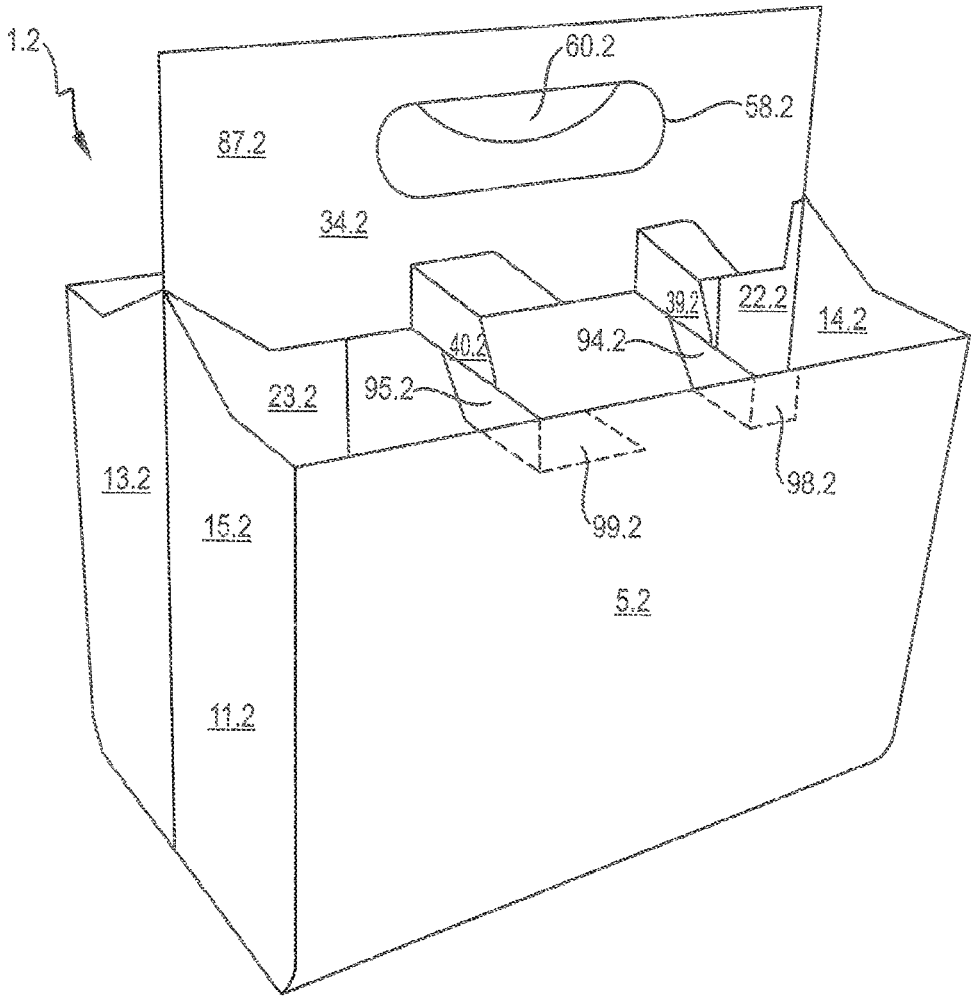
FIG. 4 a bottle carrier formed from the blanks from FIG. 3 in a perspective view diagonally from the top and from the side.

The exemplary embodiment in FIGS. 3 and 4 differs from the exemplary embodiment described above in that for one, in the case of the blank 2.2, the separating webs 37.2 through 40.2 are only linked to the outer handle walls via an inner web folding line 41.2 through 44.2 and are not linked to the longitudinal walls 4.2, 5.2. Accordingly, the neighboring edge areas of the longitudinal walls 4.2, 5.2 have no cutouts for the formation of parts of the separating webs. The edges of the longitudinal walls 4.2, 5.2 facing each other are rather straight.

The blank 3.2 differs from the blank 3.1 in that the insert walls 79.2, 80.2 of the insert 78.2 have linked additional separating webs 92.2 through 95.2 on the edges facing away from each other via additional inner web folding lines 88.2 through 91.2. The additional inner web folding lines 88.2 through 91.2 are aligned perpendicular to the insert folding line 81.2. The additional separating webs 92.2 through 95.2 have an inner section connected with the additional inner web folding line 88.2 through 91.2 and an outer section connected with it via a bending. The inner section and the outer section each run parallel and the bending at an angle of 45° to the insert folding line 81.2. Each outer section has a web connecting strap 96.2 through 99.2 on the outer end, which is linked via an additional outer web folding line 100.2 through 103.2. The additional outer web folding line 100.2 through 103.2 is aligned perpendicular to the insert folding line 81.2.

The bottle carrier 1.2 is generally assembled like the bottle carrier 1.1. Additionally, the additional separating webs 92.2 through 95.2 are glued with the separating webs 37.2 through 40.2 during placement of the insert 78.2 on the blank 2.2 and the web connecting straps 96.2 through 99.2 are glued with the longitudinal walls 4.2, 5.2.

The erecting of the bottle carrier 1.2 takes place as for bottle carrier 1.1 and dividers also hereby form on both sides of the handle.

Bottles can be inserted into the dividers.

The bottle carrier 1.2 has the advantage that the longitudinal walls 4,2, 5.5 in the upper area are not impaired by recesses, which benefits the rigidity of the bottle carrier 1.2 and the usability of the longitudinal walls 4.2, 5.2 for imprints.

Figure 5:
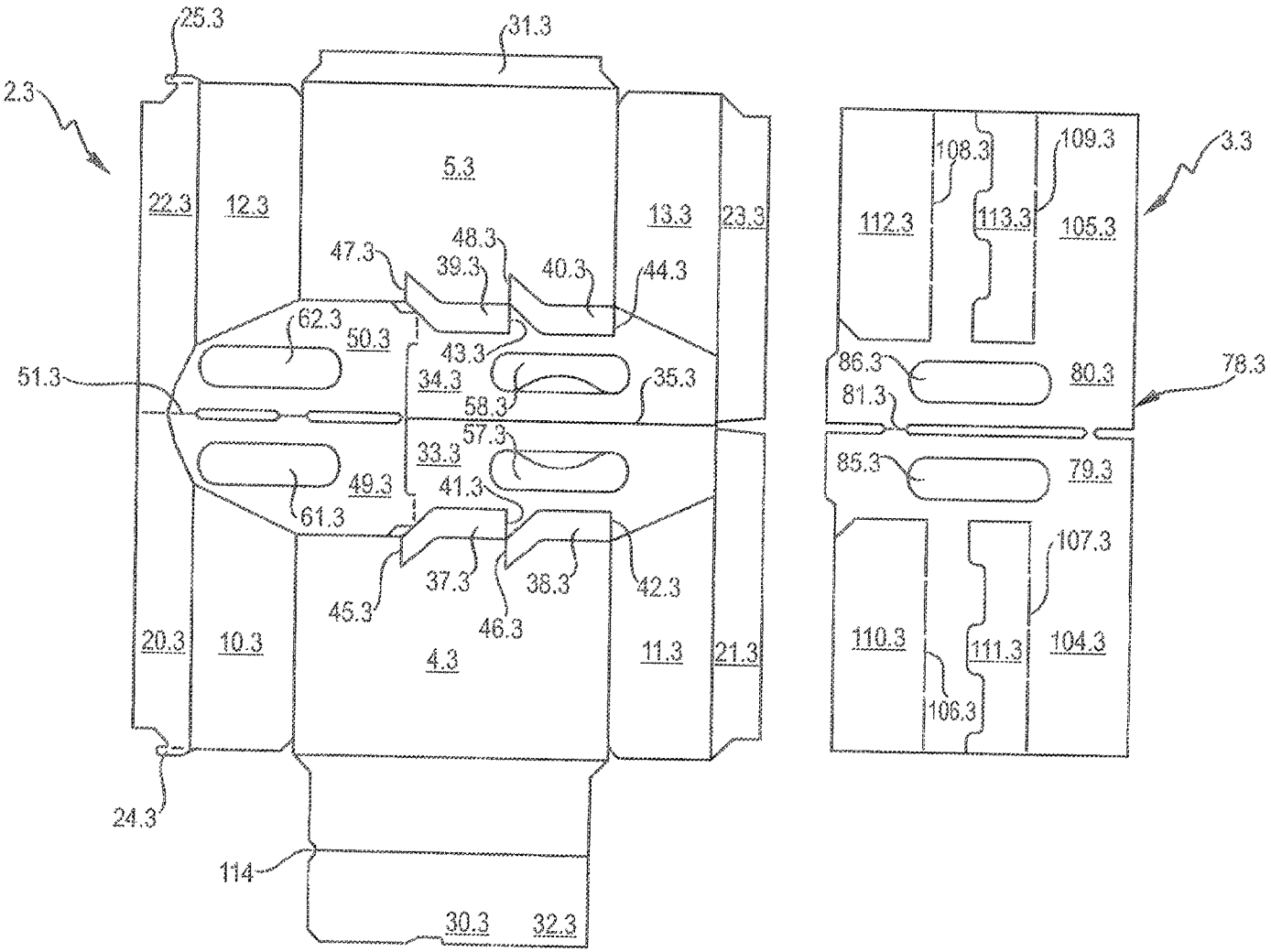
FIG. 5 blanks of a bottle carrier with an insert for stabilizing the bottle carrier, forming middle walls and separating flaps in a top view.
Figure 6:
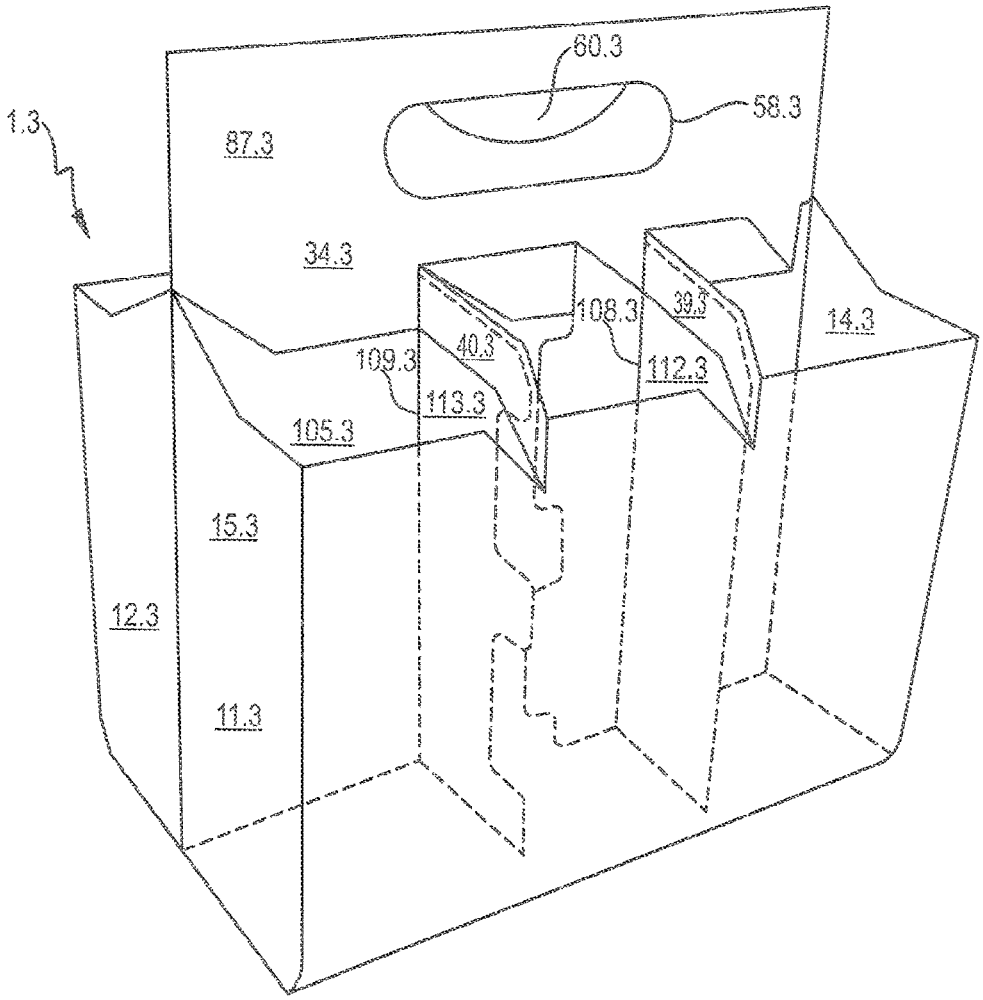
FIG. 6 a bottle carrier formed from the blanks from FIG. 5 in a perspective view diagonally from the top and from the side.

The bottle carrier 1.3 according to FIGS. 5 and 6 differs from the bottle carrier 1.1 mainly in that each of the insert walls 79.3, 80.3 are provided on the outside with a middle wall section 104.3, 105.3. In each middle wall section 104.3, 105.3, separating walls 110.3 through 113.3 are defined via perforated lines and separating wall folding lines 106.3 through 109.3 aligned perpendicular to the insert folding line 81.3. Each middle wall section 104.3, 105.3 comprises a mainly rectangular separating wall 110.3, 112.3 and a separating wall 111.3, 113.3 with an edge having alternately protrusions and impressions on the side lying opposite the separating wall folding line 107.3, 109.3.

Furthermore, only connecting straps 22.3, 21.3 are provided with hooks 24.3, 25.3; the connecting flaps 21.3, 23.3 have no hooks. The bottom wall section 30.3 has no receivers for mandrels and is only provided on an edge with an edge recess 114 for receiving the hooks 24.3, 25.3.

Assembly of the bottle carrier 1.3 proceeds generally in the same manner as for assembly of the bottle carrier 1.1. During positioning of the blank 3.3 on the blank 2.3, the separating walls 110.3 through 113.3 are glued with them in the overlapping areas with the separating webs 37.3 through 40.3.

The erection of the bottle carrier 1.3 takes place in the manner already described for the bottle carrier 1.1. The separating walls 110.3 through 113.3 are hereby folded out with the separating webs 37.3 through 40.3. The other parts of the middle wall sections 104.3, 105.3 remain in a vertical plane below the handle 87.3.

This bottle carrier 1.3 also has an increased stability. Additionally, glass contact between the bottles in the neighboring dividers on the same side of the handle 87.3 and between bottles in neighboring dividers on different sides of the handle 87.3 is effectively prevented.

Figure 7:
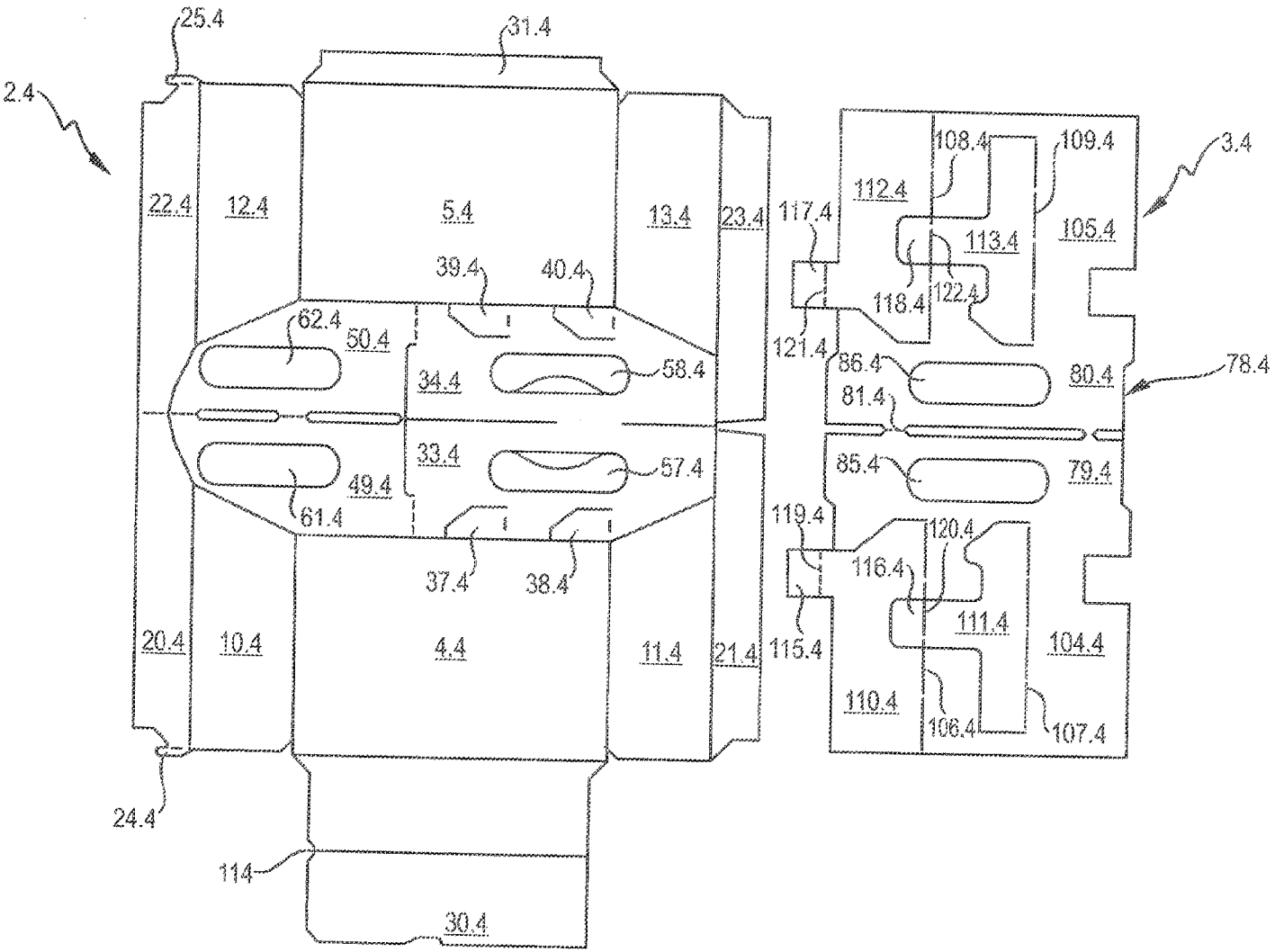
FIG. 7 blanks of a bottle carrier with an insert for stabilizing the bottle carrier, forming middle walls and separating flaps and connecting with the side walls in a top view.
Figure 8:
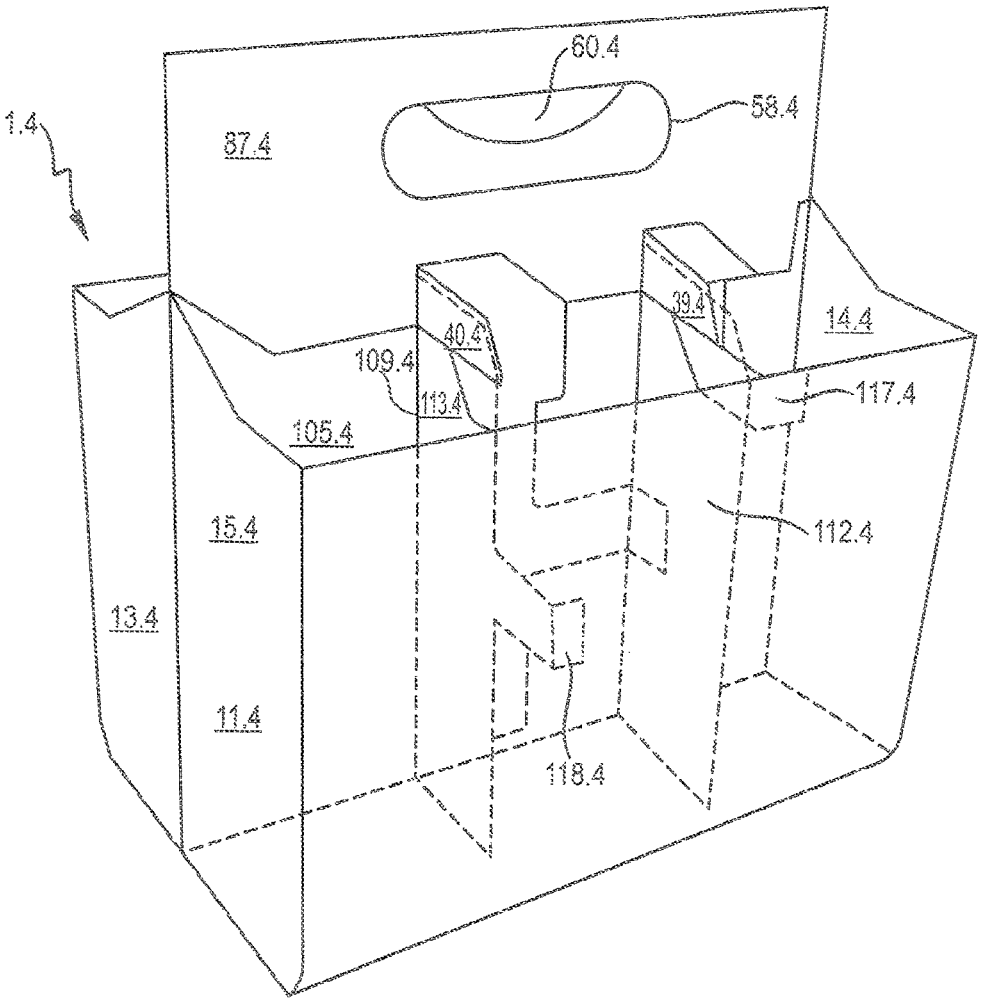
FIG. 8 a bottle carrier formed from the blanks from FIG. 7 in a perspective view diagonally from the top and from the side.

The bottle carrier 1.4 according to FIGS. 7 and 8 comprises a blank 2.4, which mainly corresponds with the blank 2.2. Differing from this, the bottom wall section 30.4 has no perforated lines for mandrels and no edge-side incision. Moreover, the adjacent areas of the outer handle walls 33.4, 34.4, of the inner handle walls 49.4, 50.4, of the front wall sections 10.4 through 13.4 as well as the connecting straps 20.4 through 23.4 have contours deviating slightly from the corresponding components of the blank 2.2.

The blank 3.4 has the same components as the blank 3.3, whereby they are assembled slightly different in detail. Additionally, the separating flaps 110.4 through 113.4 have separating flap connecting straps 115.4 through 118.4 on the ends removed from the separating flap folding lines 106.4 through 109.4. The separating flap connecting straps 115.4 through 118.4 are linked to the separating flaps 110.4 through 113.4 via outer separating flap folding lines 119.4 through 122.4. The blank 3.4 is designed such that the left edge of the blank in FIG. 7 is complementary to the right edge of the blank in FIG. 7. This has the advantage that several blanks 3.4 can be cut from a sheet or from a web of foldable flat material in a material-saving manner.

Assembly of the bottle carrier 1.4 proceeds generally in the same manner as for assembly of the bottle carrier 1.2. During positioning of the blank 3.4 on the blank 2.4, the separating walls 110.4 through 113.4 are glued with them in the overlapping areas with the separating webs 37.4 through 40.4. Moreover, the separating flap connecting straps 115.4 through 118.4—according to the web connecting straps 96.2 through 98.2—are glued with the longitudinal walls 4.4, 5.4.

The erection of the bottle carrier 1.4 takes place as for the bottle carriers 1.1 through 1.3 described above. Dividers are also hereby formed on both sides of the handle, into which the bottles can be inserted.

The bottle carrier 1.4 has the advantage that the longitudinal walls 4,4, 5.4 in the upper area are not impaired by recesses, which benefits the rigidity of the bottle carrier 1.4 and the usability of the longitudinal walls 4.4, 5.4 for imprints.

Additionally, glass contact between the bottles in the neighboring dividers on the same side of the handle 87.4 and on different sides of the handle is avoided particularly effectively.

This completes the description of the preferred and alternate embodiments of the invention. Those skilled in the art may recognize other equivalents to the specific embodiment described herein which equivalents are intended to be encompassed by the claims attached hereto.

LIST OF REFERENCES

1 Bottle carrier
2 Blank
3 Blank
4, 5 Longitudinal wall
6 through 9 Side folding line
10 through 13 Front wall section
14, 15 Front wall
16 through 19 Front folding line
20 through 23 Connecting strap
24, 25 Hook
26, 27 Hook
28, 29 Bottom folding line
30, 31 Bottom wall section
32 Bottom wall
33, 34 Outer handle wall
35 Outer handle folding line
36 Strip-like cutout
37 through 40 Separating web
41 through 44 Inner web folding line
45 through 48 Outer web folding line
49, 50 Inner handle wall
51 Inner handle folding line
52 through 53 Strip-like cutout
54, 55 Front-side handle folding line
56 Connecting folding line
57, 58 Outer handle opening
59, 60 Handle release strap
61, 62 Inner handle opening
63 Central bottom folding line
64, 65 Circular cutout
66, 67 Folding line arrangement
68 through 71 Perforated line
72 through 75 Perforated line
76 Incision
77 Additional incision
78 Insert
79, 80 Insert wall
81 Insert folding line
82 through 84 Strip-like cutout
85, 86 Additional inner handle opening
87 Handle
88 through 91 Additional inner web folding line
92 through 95 Additional separating web
96 through 98 Web connecting strap
100 through 103 Additional outer web folding line
104, 105 Middle wall section
106 through 109 Separating flap folding lines
110 through 113 Separating flap
114 Edge recess
115 through 118 Separating flap connecting strap
119 through 122 Separating flap folding lines

What is claimed is:

1. A bottle carrier made of foldable flat material with:

a handle (87) comprising two outer handle walls (33, 34) that cover each other and two inner handle walls (49, 50) arranged between the outer handle walls (33, 34), front walls (14, 15), which are aligned perpendicular to the handle (87) and have respectively two front wall sections (10 through 13) on different sides of the handle (87), connecting straps (20 through 23), each of which are connected with an inner edge of the front wall section (10 through 13) via a front folding line (16 through 19) so that the front folding lines (16 through 19) are folded between front-side edge areas of the outer handle walls (49, 50) and connected with the handle (87), longitudinal walls (4, 5), which extend parallel to the handle (87) and each of which are connected with the outer edges of two front wall sections (10 through 13) of different side walls (14, 15) via side folding lines (6 through 9), a bottom wall (32), which is connected with the lower edges of the longitudinal walls (4, 5) via bottom folding lines (28, 29), separating webs (37 through 40), which are connected with the lower edge areas of the outer handle walls (49, 50) via inner web folding lines (41 through 44) so that the inner web folding lines (41 through 44) are folded out of the lower edge areas of the outer handle walls (49, 50) and aligned parallel to the front walls (14, 15), wherein a separate insert (78) is arranged between the two outer handle walls (49, 50), which has inner front-side edge areas on both front sides, which overlap with the connecting straps (20 through 23) and are connected with them, the insert (78) having overlapping insert walls (79, 80), the inner handle walls (49, 50) being interconnected on the top via an inner handle folding line (51) and folded together around the inner handle folding line (51), wherein the insert (78) has on the bottom at least one middle wall section (104, 105) protruding over the inner web folding lines (41 through 44), wherein the middle wall sections (104, 105) have separating flaps (110 through 113) linked via vertical separating wall folding lines (106 through 109) adjacent to neighboring separating webs (37 through 40), which are connected with them in an overlapping area with the respectively neighboring separating webs (37 through 40), and further in which the separating webs (37 through 40) end before the respectively neighboring longitudinal walls (45) and the separating flaps (110 through 113) are connected with the insides of the neighboring longitudinal walls (4, 5) on the outer ends via separating flap connecting straps (115 through 118).

2. The bottle carrier according to claim 1, in which the two outer handle walls (33, 34) are interconnected on the top by an outer handle folding line (35) and are folded together around the outer handle folding line (35) and in which the inner handle walls (49, 50) are connected with the front-side edges of the outer handle walls (33, 34) via front-side handle folding lines (54, 55) and are folded against the outer handle walls (33, 34) around the front-side handle folding lines (54, 55).

3. The bottle carrier according to claim 1, in which the connecting straps (20 through 23) on one of the two front walls (14, 15) are connected with the front-side edges of the outer handle walls (33, 34) on the top via continuations of the front folding lines (16 through 19).

4. The bottle carrier according to claim 1, in which the two overlapping insert walls (79, 80) are interconnected on the top along an insert folding line (81), which is arranged below the outer handle folding line (35).

5. The bottle carrier according to claim 1, in which the insert (78) does not protrude on the bottom over the deepest points of the outer handle walls (33, 34) and of the inner handle walls (49, 50).

6. The bottle carrier according to claim 5, in which the insert (78) has a straight bottom edge, which is arranged at the height of the bottom ends of the inner web folding lines (41 through 44).

7. The bottle carrier according to claim 1, in which the height of the front wall sections (10 through 13) increases towards the handle (87).

8. The bottle carrier according to claim 1, in which the separating webs (37 through 40) are connected with the upper edge areas of the longitudinal wall (45) on the same side of the handle (87) on the outside via outer web folding lines (45 through 48).

9. The bottle carrier according to claim 1, in which the separating webs (37 through 40) end before the respectively neighboring longitudinal walls (4, 5) and the insert (78) links additional separating webs (92 through 95) to the lower edge areas of the two insert walls (79, 80) via additional, inner web folding lines (88 through 91), which are folded out of the insert walls (79, 80), connected with the separating webs (37 through 40) in an inner section overlapping the separating webs (37 through 40) and connected with the insides of the neighboring longitudinal walls (4, 5) on the outer ends via web connecting straps (96 through 98).

10. The bottle carrier according to claim 1, in which both insert walls (79, 80) have on the bottom a middle wall section (104, 105).

11. The bottle carrier according to claim 1, in which at least one middle wall section (104, 105) is arranged between a front wall (14, 15) and an inner web folding line (41 through 44) and/or between two inner web folding lines (41 through 44).

12. The bottle carrier according to claim 1, in which the outer handle walls (33, 34), the inner handle walls (49, 50) and the insert (78) have overlapping handle openings (57, 58, 61, 62, 85, 86).

13. The bottle carrier according to claim 1, in which the outer and inner handle walls (33, 34), the front walls (14, 15), the connecting straps (20 through 23), the longitudinal walls (4, 5), the bottom wall (32) and the separating webs (37 through 40) are made of a first one-piece cut of foldable flat material and in which the insert (78) is made of a second one-piece blank of foldable flat material.

14. The bottle carrier according to claim 1, which has at least one imprint on the outsides of the outer handle walls (33, 34) and/or of the front walls (14, 15) and/or of the bottom wall (32) and/or of the insert (78).

15. The bottle carrier according to claim 14, in which the insert (78) is a wastepaper sheet.

16. The bottle carrier according to claim 15, in which the wastepaper sheet is subsequently provided with an imprint.

* * * * *